US010546673B2

(12) United States Patent
Mizoguchi et al.

(10) Patent No.: US 10,546,673 B2
(45) Date of Patent: Jan. 28, 2020

(54) NDFEB SYSTEM SINTERED MAGNET

(71) Applicant: INTERMETALLICS CO., LTD., Nakatsugawa-shi, Gifu (JP)

(72) Inventors: Tetsuhiko Mizoguchi, Kyoto (JP); Masato Sagawa, Kyoto (JP)

(73) Assignee: INTERMETALLICS CO., LTD., Nakatsugawa (JP)

( * ) Notice: Subject to any disclaimer, the term of this patent is extended or adjusted under 35 U.S.C. 154(b) by 190 days.

(21) Appl. No.: 14/419,350

(22) PCT Filed: Aug. 27, 2013

(86) PCT No.: PCT/JP2013/072842
§ 371 (c)(1),
(2) Date: Feb. 3, 2015

(87) PCT Pub. No.: WO2014/034650
PCT Pub. Date: Mar. 6, 2014

(65) Prior Publication Data

US 2015/0221423 A1 Aug. 6, 2015

(30) Foreign Application Priority Data

Aug. 27, 2012 (JP) ..... 2012-186584

(51) Int. Cl.
*H01F 1/053* (2006.01)
*H01F 1/057* (2006.01)
(Continued)

(52) U.S. Cl.
CPC ..... *H01F 1/0577* (2013.01); *C22C 38/002* (2013.01); *C22C 38/005* (2013.01);
(Continued)

(58) Field of Classification Search
CPC ..... H01F 1/0536
See application file for complete search history.

(56) References Cited

U.S. PATENT DOCUMENTS

2007/0175544 A1 8/2007 Hasegawa et al.
2009/0252865 A1* 10/2009 Sagawa ..... B22F 3/1039 427/127
(Continued)

FOREIGN PATENT DOCUMENTS

CN 1969347 A 5/2007
CN 101809689 A 8/2010
(Continued)

OTHER PUBLICATIONS

Uestuener. Dependence of the Mean Grain Size and Coercivity of Sintered Nd—Fe—B Magnets on the Initial Powder Particle Size. IEEE Transactions on Magnetics, vol. 42, No. 10, Oct. 2006.*
(Continued)

*Primary Examiner* — Matthew E. Hoban
(74) *Attorney, Agent, or Firm* — Oliff PLC

(57) ABSTRACT

The present invention aims to provide a NdFeB system sintered magnet capable of improving the magnetization characteristic. The NdFeB system sintered magnet is a NdFeB system sintered magnet with the c axis oriented in one direction, characterized in that: the median of the grain size of the crystal grains at a section perpendicular to the c axis is 4.5 μm or less, and the area ratio of the crystal grains having grain sizes of 1.8 μm or smaller on the aforementioned section is 5% or lower. The median of the grain size is decreased (to 4.5 μm or less), whereby improve the coercive force is improved. Simultaneously, the area ratio of the crystal grains having grain sizes of 1.8 μm or smaller is decreased (to 5% or lower) to reduce the number of crystal grains having no magnetic wall formed, whereby the magnetization characteristic is improved.

10 Claims, 12 Drawing Sheets

(51) Int. Cl.

| | |
|---|---|
| ***C22C 38/00*** | (2006.01) |
| ***C22C 38/06*** | (2006.01) |
| ***C22C 38/10*** | (2006.01) |
| ***C22C 38/16*** | (2006.01) |
| ***H01F 1/08*** | (2006.01) |
| *H01F 41/02* | (2006.01) |

(52) U.S. Cl.
CPC ..... *C22C 38/06* (2013.01); *C22C 38/10* (2013.01); *C22C 38/16* (2013.01); *H01F 1/086* (2013.01); *H01F 41/0293* (2013.01)

(56) References Cited

U.S. PATENT DOCUMENTS

| | | | |
|---|---|---|---|
| 2010/0194509 | A1 | 8/2010 | Suzuki et al. |
| 2012/0064671 | A1 | 3/2012 | Brun et al. |
| 2013/0189426 | A1 | 7/2013 | Sagawa |

FOREIGN PATENT DOCUMENTS

| | | | |
|---|---|---|---|
| JP | 2005197662 | A | 7/2005 |
| JP | 2005320628 | A | 11/2005 |
| JP | 2006019521 | A | 1/2006 |
| JP | 2010-177603 | A | 8/2010 |
| JP | 2012060139 | A | 3/2012 |
| WO | 2008032426 | A1 | 3/2008 |
| WO | 2012/008623 | A1 | 1/2012 |
| WO | 2013146781 | A1 | 10/2013 |

OTHER PUBLICATIONS

Malvern Panalytical. "Laser Diffraction (LD)". https://www.malvernpanalytical.com/en/products/technology/light-scattering/laser-diffraction. Retrieved on Jul. 9, 2018.*

Apr. 22, 2016 Office Action issued in Korean Patent Application No. 10-2015-7004431.

Sep. 9, 2015 extended Search Report issued in European Patent Application No. 13833670.6.

Dec. 10, 2013 International Search Report issued in International Patent Application No. PCT/JP2013/072842.

Mar. 3, 2015 International Preliminary Report on Patentability issued in International Application No. PCT/JP2013/072842.

Mar. 21, 2017 Office Action issued in Japanese Patent Application No. 2014-533015.

Sep. 13, 2016 Office Action issued in Chinese Patent Application No. 201380045295.8.

May 3, 2017 Office Action issued in Chinese Patent Application No. 201380045295.8.

* cited by examiner

NDFEB SYSTEM SINTERED MAGNET

TECHNICAL FIELD

The present invention relates to a NdFeB system sintered magnet containing $Nd_2Fe_{14}B$ as its main phase. The "NdFeB system sintered magnet" is not limited to the magnet which contains only Nd, Fe and B; it may additionally contain a rare-earth element other than Nd as well as other elements, such as Co, Ni, Cu and/or Al. It should be noted that the "NdFeB system sintered magnet" in the present application includes both a sintered body before the magnetizing process and a sintered magnet after the magnetizing process.

BACKGROUND ART

NdFeB system sintered magnets were discovered in 1982 by Sagawa (one of the present inventors) and other researchers. The magnets have the characteristic that many of their magnetic characteristics (e.g. residual magnetic flux density) are far better than those of other conventional permanent magnets. Hence, NdFeB system sintered magnets are used in a variety of products, such as driving motors for hybrid or electric cars, battery-assisted bicycle motors, industrial motors, voice coil motors used in hard disk drives and other apparatuses, high-grade speakers, headphones, and permanent magnetic resonance imaging systems.

Initial versions of the NdFeB system sintered magnet had the problem that its coercive force $H_{cJ}$ was comparatively low among the various magnetic characteristics. Methods for solving this problem have been commonly known, such as: (1) a method in which a heavy rare-earth element $R_H$ (e.g. Dy and/or Tb) is added to an alloy material to improve the crystalline magnetic anisotropy of the main phase; (2) a method in which two kinds of starting alloy powder, including a main phase alloy which does not contain $R_H$ and a grain boundary phase alloy to which $R_H$ is added, are mixed together and sintered (binary alloy blending technique); and (3) a method in which the size of the individual crystal grains forming the NdFeB system sintered magnet is reduced.

Among these examples, method (3) has the advantage that the coercive force $H_{cJ}$ can be enhanced without lowering the residual magnetic flux density $B_r$. Although its mechanism has not been completely solved, a qualitative interpretation of this phenomenon is that reducing the grain size decreases the number of crystal defects which serve as the sites for reverse magnetic domains to occur in a region near the grain boundaries.

To decrease the size of the crystal grains, it is necessary to reduce the particle size of the alloy powder at the stage of the alloy powder as the material of the sintered magnet. However, as the particle size decreases, the total surface area of the particles of the alloy powder increases, so that the powder becomes easier to be oxidized. In particular, NdFeB system alloy is extremely reactive with oxygen and may possibly ignite. Accordingly, for the reduction of the particle size of the alloy powder, it is necessary to take sufficient countermeasures against oxidization in the material handling and subsequent processes.

Meanwhile, Patent Literature 1 discloses a method in which alloy powder is put in a container and subjected to a magnetic orientation process without being pressed (the so-called "press-less method"). The press-less method is characterized in that the individual particles of the alloy powder are comparatively free to rotate during the magnetic orientation process, which produces the effect of improving the degree of orientation and thereby enhancing the residual magnetic flux density of the eventually created magnet.

In the press-less method, since there is no need to use a large-sized press or similar machine in the magnetic orientation and other magnet production processes, it is easy to perform the entire process in a specific atmosphere (e.g. oxygen-free atmosphere). Actually, such a process is disclosed in Patent Literature 1, whereby the size of the crystal grains can be reduced and the influence of the oxidization can be prevented, so that a NdFeB system sintered magnet with a high level of coercive force $H_{cJ}$ can be created.

CITATION LIST

Patent Literature

Patent Literature 1: JP 2006-019521 A
Patent Literature 2: WO 2008/032426

SUMMARY OF INVENTION

Technical Problem

NdFeB system sintered magnets do not only need to have high coercive force but also a high magnetization characteristic. The magnetization characteristic is hereinafter described.

In a process of producing a NdFeB system sintered magnet, the temperature is raised to roughly 1000° C. in the sintering process. Since this temperature is higher than the Curie temperature (approximately 310° C.), the sintered body obtained through the sintering process is no longer magnetized in its entirety. Therefore, a process of magnetizing the obtained sintered body is performed by applying a magnetic field to the sintered body. Such a process is called "magnetization." NdFeB system sintered magnets have the characteristic that, as the strength of the external magnetic field increases, the amount of magnetization rapidly increases from the thermally demagnetized state, due to the so-called "nucleation type" coercivity mechanism. Therefore, NdFeB system sintered magnets normally become magnetized in a magnetic field of approximately 20 kOe, which is lower than the level at which SmCo system sintered magnets having the so-called "pinning type" coercivity mechanism are magnetized. However, if the size of the crystal grains is reduced in the previously described manner to enhance the coercive force $H_{cJ}$ without decreasing the residual magnetic flux density Br, the problem of the deterioration of the magnetization characteristic becomes noticeable.

NdFeB system sintered magnets obtained through the magnetizing process have strong magnetization and are difficult to handle. Therefore, in many cases, a sintered body of a NdFeB system sintered magnet produced without the magnetizing process is shipped, and later on, in the stage of producing a product (e.g. motor) which uses the NdFeB system sintered magnet, the magnetizing process is performed after the magnet is set in the product. Usually, the external magnetic field that can be applied to the magnet under such a condition is weaker than that applied in the production of the sintered magnet.

The problem to be solved by the present invention is to provide a NdFeB system sintered magnet having an improved magnetization characteristic while reducing the size of the crystal grains so as to increase the coercive force of the NdFeB system sintered magnet.

Solution to Problem

The present invention aimed at solving the previously describe problem is a NdFeB system sintered magnet with the c axis oriented in one direction, characterized in that:

the median of the grain size of the crystal grains at a section perpendicular to the c axis is 4.5 μm or smaller; and the area ratio of the crystal grains having grain sizes of 1.8 μm or smaller on the aforementioned section is 5% or lower.

The NdFeB system sintered magnet according to the present invention may have a structure in which the area ratio of the crystal grains with the median of the grain size being 1.6 μm or less is 2% or lower.

In the present application, the grain size of each crystal grain at the aforementioned section is defined as the diameter of a circle whose area is equal to the sectional area of that crystal grain on the aforementioned section calculated by image processing or a similar method.

In the NdFeB system sintered magnet according to the present invention, the reason why the median of the grain size of the crystal grains at a section perpendicular to the c axis of the sintered body (this section is hereinafter called the "$c_{\perp}$ plane") is made to be 4.5 μm or less is to increase the coercive force. For the median of the grain size of the crystal grains to be 4.5 μm or less, the particle size of the alloy powder to be used as the material of the sintered body should be approximately 3.5 μm or smaller, and more preferably 3.0 μm or smaller, in terms of the median as measured by a laser type apparatus for measuring a particle-size distribution of powder (see Patent Literature 1; it should be noted that this median is different from the median of the grain size of the crystal grains at the aforementioned section of the NdFeB system sintered magnet).

The reason why the area ratio of the crystal grains having grain sizes of 1.8 μm or smaller on the $c_{\perp}$ plane is made to be 5% or lower is hereinafter described. The present inventors have conducted two measurements: In one measurement, the grain size distribution of the crystal grains on the $c_{\perp}$ plane of a NdFeB system sintered magnet was measured. In the other measurement, a magnetic field applied to a NdFeB system sintered magnet before magnetization was increased, and during this process, a magnetic flux resulting from the magnetization was measured in each magnetic field. The obtained result demonstrated that, in the magnetic flux measurement, as the magnetic field increases, a plateau area within which the magnetic flux shows a slower increase appears over a specific range of magnetic field, after which the magnetic flux once more increases in the higher range of the magnetic field. The present inventors also found that the value obtained by subtracting the magnetization ratio (in percentage) in the plateau area from 100% is approximate to the area ratio of the crystal grains whose grain size on the $c_{\perp}$ plane determined by the grain size distribution measurement is 1.8 μm or smaller. This means that the crystal grains whose grain size on the $c_{\perp}$ plane is 1.8 μm or smaller are single-domain grains. That is to say, the plateau area appears due to the fact that those crystal grains are single-domain grains and do not become magnetized within the aforementioned specific range of the magnetic field (the reason will be explained later). Accordingly, the magnetization characteristic improves with a decrease in the ratio of the area occupied on the aforementioned section of the sintered body by the crystal grains of the single-domain grains whose grain size is 1.8 μm or smaller. Specifically, by decreasing the ratio of the area occupied by those crystal grains to 5% or a lower level, the magnetization ratio achieved by a magnetizing process using an external magnetic field of 20 kOe can be improved to 90% or even higher.

The reason why the single-domain grains do not become magnetized in the aforementioned specific magnetic field (a relatively weak magnetic field) is hereinafter described, using FIG. 1. Before a magnetic field is applied, the NdFeB system sintered magnet 10 is in the thermally demagnetized state (a), in which each crystal grain of a comparatively large size is in the form of a multi-domain grain 11 divided into multiple domains 13 by magnetic walls, while each crystal grain of a small size is in the form of a single-domain grain 12 with no magnetic wall. When a magnetic field is applied to the NdFeB system sintered magnet 10, the magnetic walls in the crystal grains of the multi-domain grains 11 smoothly move and a compliant magnetization grows even in a comparatively weak magnetic field, causing their magnetizations to be oriented in the direction of the magnetic field (b). By contrast, in the single-domain grains 12, no reversal of magnetization occurs since no domain is formed in such a weak magnetic field that causes the magnetization of the multi-domain grains 11. Thus, in the aforementioned specific magnetic field, only the multi-domain grains 11 have their magnetizations oriented in the direction of the magnetic field, and the single-domain grains 12 are non-uniform in their direction of magnetization. The reverse magnetic domains 14 in the single-domain grains 12 are formed for the first time when a magnetic field stronger than the aforementioned one is applied (c). When a further stronger magnetic field is applied, the magnetic walls generated in the single-domain grains 12 smoothly move, causing the magnetizations of the single-domain grains 12 to be oriented in the direction of the magnetic field (d). Eventually, the magnetizations of all the crystal grains of the NdFeB system sintered magnet 10 are oriented in the direction of the magnetic field. Thus, the NdFeB system sintered magnet 10 is magnetized.

In the NdFeB system sintered magnet, the ratio of the area occupied by the crystal grains whose grain size on the $c_{\perp}$ plane is 1.8 μm or smaller can be regulated, for example, by the following methods:

The first method is to regulate the area ratio through the content ratio of the rare-earth element in the alloy powder used as the material. Specifically, the area ratio can be decreased by increasing the aforementioned content ratio. By this operation, the amount of rare-earth rich phase having a higher content ratio of rare earth than the surrounding area increases in the grain boundary of the crystal grains, which probably helps absorption of smaller crystal grains into larger ones during the sintering process and decreases the ratio of the smaller crystal grains. Such a regulation of the content ratio can be performed in a preliminary experiment. In a preliminary experiment conducted by the present inventors, when the content ratio of the rare-earth element was 31% by weight or higher, the ratio of the area occupied by the crystal grains having grain sizes of 1.8 μm or smaller could be decreased to 5% or lower. This result will be detailed later as examples of the present invention.

The second method is to regulate the area ratio through the sintering conditions. For example, the sintering temperature is set as high as possible and/or the sintering time is set as long as possible within a range where no coarse grain is formed. Raising the sintering temperature in this manner increases the amount of Nd rich-phase in the grain boundary and thereby contributes to an easy absorption of small crystal grains into the other ones. Increasing the sintering time directly contributes to the easy absorption of small crystal grains into the other ones.

In the NdFeB system sintered magnet according to the present invention, the magnet may preferably contain one or more kinds of metal elements having a melting point of 700° C. or lower. Among those elements, an element having a melting point of 400° C. or lower is more desirable, and still more desirable is an element having a melting point of 200° C. or lower. When such an element is contained in the NdFeB system sintered magnet, the metal of the element melts into liquid form during the sintering process. This liquid absorbs small crystal grains of the NdFeB system and dissolves them, so that the ratio of those small crystal grains is lowered. Examples of such metal elements include Al (660° C.), Mg (650° C.), Zn (420° C.), Ga (30° C.), In (157° C.), Sn (252° C.), Sb (631° C.), Te (450° C.), Pb (327° C.) and Bi (271° C.), where the numbers in parenthesis are melting points.

Advantageous Effects of the Invention

By the present invention, a NdFeB system sintered magnet having high coercive force as well as a high magnetization characteristic can be obtained.

DESCRIPTION OF EMBODIMENTS

Figure 1:
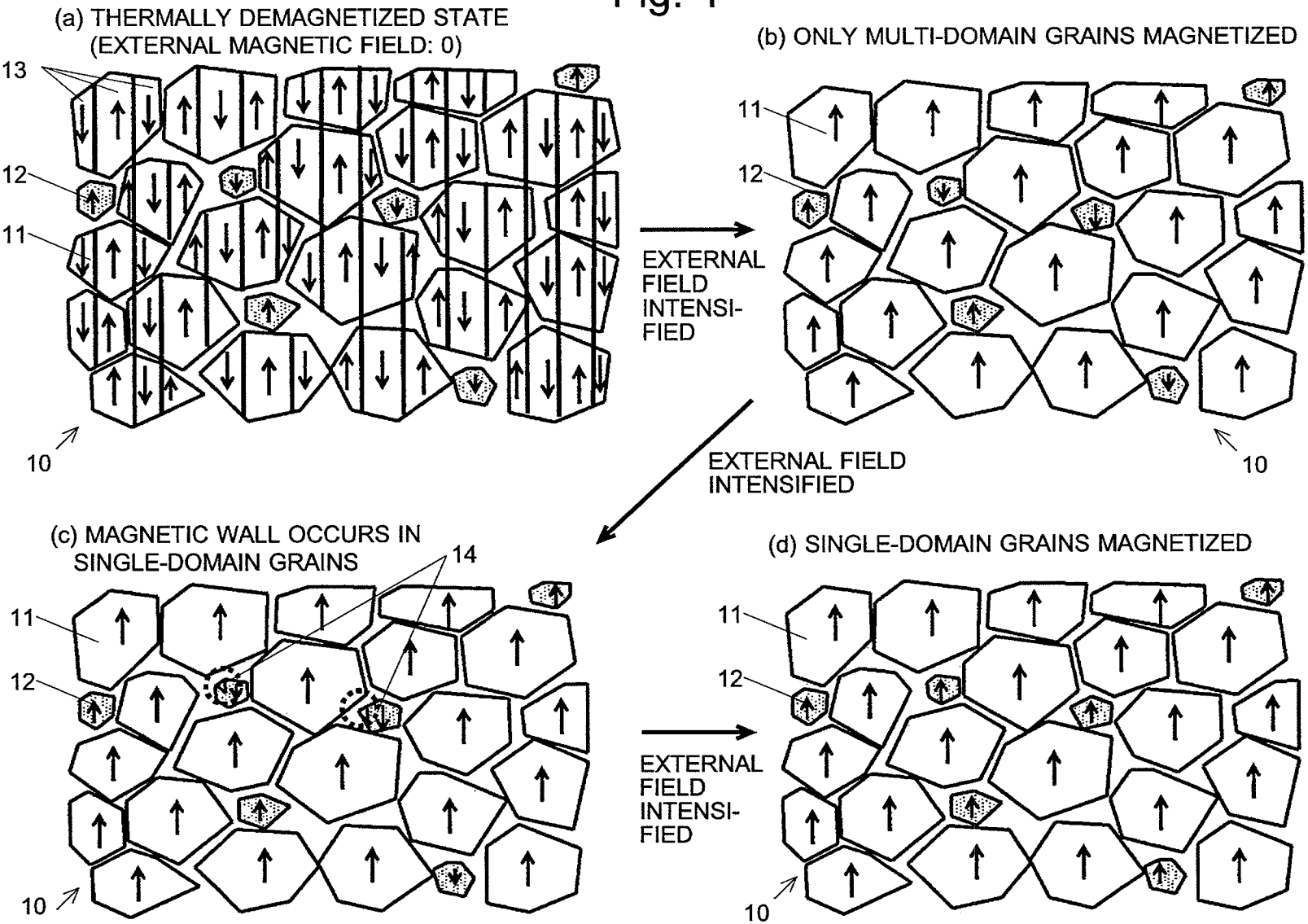
FIG. 1 is a diagram for explaining the reason why single-domain grains do not become magnetized in a comparatively weak magnetic field.

Examples of the NdFeB system sintered magnet according to the present invention are hereinafter described using FIGS. 2 through 22.

Examples

In the present examples, NdFeB system sintered magnets with five different compositions shown as "Composition 1" through "Composition 5" in Table 1 were created by a press-less method, which will be described later.

TABLE 1

Compositions of NdFeB System Sintered Magnets (before Grain Boundary Diffusion Process) (Unit: % by Weight)

| | TRE | Nd | Pr | Dy | B | Co | Ga | Al | Cu | Fe |
|---|---|---|---|---|---|---|---|---|---|---|
| Composition 1 | 33.22 | 33.1 | 0.12 | 0 | 0.98 | 0 | 0 | 0.20 | 0.10 | bal. |
| Composition 2 | 31.28 | 23.83 | 5.04 | 2.41 | 0.98 | 0 | 0 | 0.17 | 0.13 | bal. |
| Composition 3 | 31.31 | 26.5 | 4.81 | 0 | 0.99 | 1.97 | 0 | 0.22 | 0.12 | bal |
| Composition 4 | 31.49 | 26.2 | 5.01 | 0.28 | 0.98 | 0 | 0.2 | 0.18 | 0.13 | bal. |
| Composition 5 | 29.15 | 21.9 | 4.87 | 2.38 | 0.92 | 1.08 | 0 | 0.26 | 0.13 | bal. |

The numerical values shown in Table 1 represent the content ratios of the respective elements in percent by weight. The "TRE" in Table 1 means the total of the content ratios of the rare-earth elements. In the present case, it represents the total of the content ratios of Nd, Pr and Dy.

Initially, a lump of alloy prepared as the starting material was coarsely pulverized by a hydrogen pulverization method and then finely pulverized using a jet mill to obtain alloy powder. For Compositions 1, 4 and 5, the alloy powder was prepared with the target value of the average particle size set at 3 μm. For Compositions 2 and 3, multiple kinds of alloy powder with different target values of the average particle size were prepared. Next, the alloy powder was put in a container having a cavity whose inner space is shaped like a plate. Without compression-molding the alloy powder in the container, a magnetic field was applied to the alloy powder in the thickness direction of the cavity to magnetically orient the c axes in the direction parallel to the thickness direction. Then, the alloy powder in the container was heated as is, to sinter the powder. The obtained sintered body was removed from the container and worked into a piece measuring 7 mm×7 mm in planer shape and 3 mm in thickness. In this manner, samples of the NdFeB system sintered magnet were created as Present Examples 1-6 and Comparative Examples 1-3. Table 2 shows the composition and the particle size of alloy powder of each of those samples. The conditions applied in grouping the samples into "Present" and "Comparative" Examples will be described later.

TABLE 2

Composition and Particle Size of Alloy Powder of Each Sample

| Sample | Composition | Median D50 of Particle Size of Alloy Powder [μm] |
|---|---|---|
| Present Example 1 | 1 | 3.05 |
| Present Example 2 | 2 | 2.88 |
| Present Example 3 | 3 | 2.83 |
| Present Example 4 | 2 | 3.28 |
| Present Example 5 | 2 | 3.73 |
| Present Example 6 | 4 | 2.91 |
| Comparative Example 1 | 5 | 2.87 |
| Comparative Example 2 | 3 | 4.31 |
| Comparative Example 3 | 2 | 4.86 |

Table 3 shows the result of a measurement of magnetic characteristics of Present Example 1, 2 and 4-6 as well as those of Comparative Examples 1 and 3. The measured magnetic characteristics were as follows: the residual magnetic flux density $B_r$, the saturation magnetization $J_s$, the coercive force $H_{cB}$ determined from the B-H (magnetic flux density-magnetic field) curve, the coercive force $H_{cJ}$ determined from the J-H (magnetization-magnetic field) curve, the maximum energy product $BH_{Max}$, $B_r/J_s$, the magnetic field $H_k$ corresponding to 90% of $B_r$, and the squareness ratio SQ ($=H_k/H_{cJ}$).

TABLE 3

Magnetic Characteristics of Samples

| Sample | $B_r$ [kG] | $J_s$ [kG] | $H_{cB}$ [kOe] | $H_{cJ}$ [kOe] | $BH_{Max}$ [MGOe] | $B_r/J_s$ [%] | $H_k$ [kOe] | SQ [%] |
|---|---|---|---|---|---|---|---|---|
| Present Example 1 | 13.614 | 14.358 | 11.035 | 16.115 | 43.7 | 94.8 | 14.987 | 93.0 |
| Present Example 2 | 13.481 | 14.218 | 13.049 | 21.846 | 44.6 | 94.8 | 20.928 | 95.8 |
| Present Example 4 | 13.364 | 13.972 | 13.099 | 21.013 | 44.0 | 95.6 | 19.844 | 94.4 |
| Present Example 5 | 13.454 | 14.093 | 13.172 | 20.231 | 44.6 | 95.5 | 19.217 | 95.0 |
| Present Example 6 | 13.697 | 14.333 | 13.156 | 16.132 | 45.7 | 95.6 | 15.222 | 94.4 |
| Comparative Example 1 | 14.121 | 14.757 | 13.411 | 19.262 | 48.5 | 95.7 | 17.952 | 93.2 |
| Comparative Example 3 | 13.264 | 13.990 | 12.928 | 19.257 | 43.2 | 94.8 | 18.339 | 95.2 |

A comparison of Present Examples 2, 4 and 5 with Comparative Example 3, all of which have the same composition, shows that Present Examples 2, 4 and 5 have higher magnetic characteristics than Comparative Example 3; in particular, their coercive force $H_{cJ}$ is characteristically high. The reason for the low coercive forces $H_a$ of Present Examples 1 and 6 as compared to the other Present and Comparative Examples shown in Table 3 is because the material used for the samples of Present Examples 1 and 6 did not contain Dy. Accordingly, those two examples cannot be simply compared with the other ones.

Table 4 shows the result of a measurement of the aforementioned magnetic characteristics performed on all the samples after a grain boundary diffusion process. The grain boundary diffusion process is a process including the steps of attaching a powder or similar material containing Dy and/or Tb to the surface of the sintered body of a NdFeB system magnet and heating it to a temperature of 750 to 950° C. to diffuse the element of Dy and/or Tb only in regions near the grain boundaries of the crystal grains in the sintered body. This process is known to be capable of improving the coercive force while reducing the decrease in the maximum energy product (for example, see Patent Literature 2). In both Present and Comparative Examples, the grain boundary diffusion process was performed by attaching powder of TbNiAl alloy (containing 92 atomic percent of Tb, 4 atomic percent of Ni and 4 atomic percent of Al) to the surface of each sample and heating the samples to 900° C. Each sample after the grain boundary process is hereinafter represented by the original sample name with suffix "G", such as "Present Example 1G" or "Comparative Example 1G." The result demonstrates that the effect of improving the coercive force while reducing the decrease in the maximum energy product was obtained with any sample, regardless of whether it was a Present or Comparative Example.

TABLE 4

Magnetic Characteristics of Samples after Grain Boundary Diffusion Process

| Sample | $B_r$ [kG] | $J_s$ [kG] | $H_{cB}$ [kOe] | $H_{cJ}$ [kOe] | $BH_{Max}$ [MGOe] | $B_r/J_s$ [%] | $H_k$ [kOe] | SQ [%] |
|---|---|---|---|---|---|---|---|---|
| Present Example 1G | 13.192 | 13.811 | 12.859 | 27.897 | 42.6 | 95.5 | 26.651 | 95.5 |
| Present Example 2G | 13.157 | 13.842 | 12.867 | 34.467 | 42.4 | 95.1 | 32.961 | 95.6 |
| Present Example 3G | 13.709 | 14.414 | 13.153 | 24.994 | 44.9 | 95.1 | 24.095 | 96.4 |
| Present Example 4G | 13.212 | 13.867 | 12.901 | 32.900 | 42.8 | 95.3 | 31.783 | 96.6 |
| Present Example 5G | 13.209 | 13.799 | 12.913 | 33.050 | 42.7 | 95.7 | 32.126 | 97.2 |
| Present Example 6G | 13.490 | 14.101 | 13.068 | 26.532 | 44.5 | 95.7 | 25.331 | 95.5 |
| Comparative Example 1G | 13.836 | 14.383 | 13.041 | 29.631 | 44.3 | 96.2 | 26.836 | 90.6 |
| Comparative Example 2G | 13.733 | 14.483 | 13.127 | 22.521 | 44.9 | 94.8 | 21.675 | 96.2 |
| Comparative Example 3G | 13.055 | 13.739 | 12.701 | 31.174 | 41.5 | 95.0 | 30.086 | 96.5 |

An experiment for measuring the magnetization characteristic of each sample was performed. The experimental method was as follows: Initially, the sample was placed in an air-core coil and magnetized in the direction of orientation of the crystal by a pulsed magnetic field generated by passing a pulsed electric current through the air-core coil. Then, the application of the magnetic field was discontinued (i.e. the external magnetic field was set to zero), whereupon a demagnetizing field $H_d$ associated with the magnetization occurred in the sample (the value of $H_d$ corresponds to that of the magnetic field H at the load point at which the B-H curve in the second quadrant intersects with a straight line having a slope proportional to the permeance coefficient $p_c$), causing the magnetization to remain. The magnetic flux resulting from this magnetization (as measured in terms of the value $B_d$ of the magnetic flux density at the load point of the B-H curve) was detected using a search coil with the number of turns of 60 (this coil was different from the aforementioned air-core coil used for applying the pulsed magnetic field) and a flux meter (FM2000, manufactured by Denshijiki Industry Co., Ltd.). In the experiment, while the intensity of the applied magnetic field was increased in a stepwise manner, the operation of discontinuing the applied magnetic field and detecting the magnetic flux was performed at each step until the detected magnetic flux reached saturation. The magnetization ratio was calculated as a proportion of the magnetic flux in a weak magnetic field, with the largest value of the detected magnetic flux defined as 100%.

Figure 2:
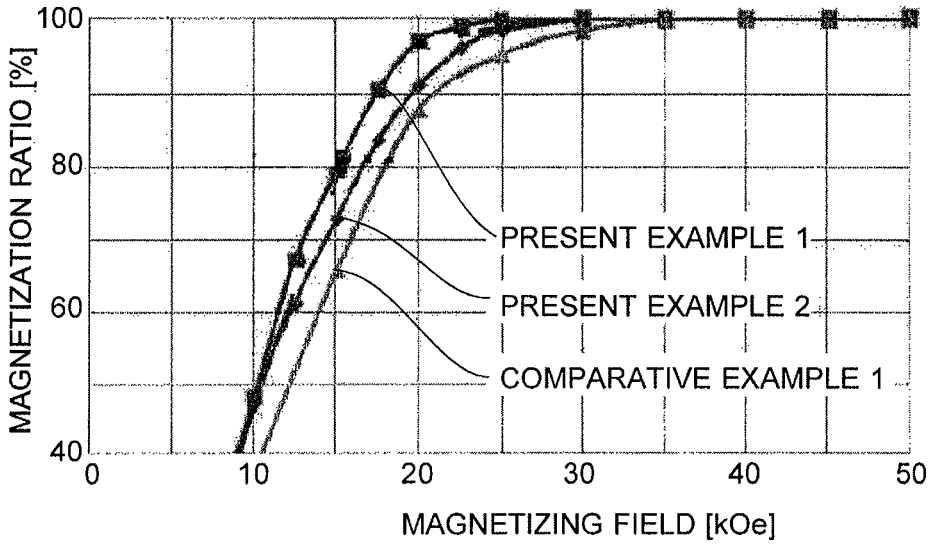
FIG. 2 is a graph showing the magnetization characteristics in Examples 1 and 2 of the NdFeB system sintered magnet according to the present invention as well as in Comparative Example 1.

FIG. 2 shows the result of the experiment of the magnetization characteristic measurement performed on Present Examples 1 and 2 as well as Comparative Example 1. The experimental result shows that the intensity of the magnetizing field at which the magnetization ratio reached 100% was 25 kOe or higher for Present Example 1, 30 kOe or higher for Present Example 2, and 35 kOe for Comparative Example 1. Thus, Present Examples 1 and 2 could be completely magnetized with weaker magnetic fields than Comparative Example 1. When the magnetizing field was 25 kOe or weaker, Present Example 1 had the highest magnetization ratio, followed by Present Example 2 and Comparative Example 1. When the magnetizing field was 20 kOe, the magnetization ratios of Present Examples 1 and 2 exceeded 90%, while that of Comparative Example 1 was 90% or lower.

Figure 3:
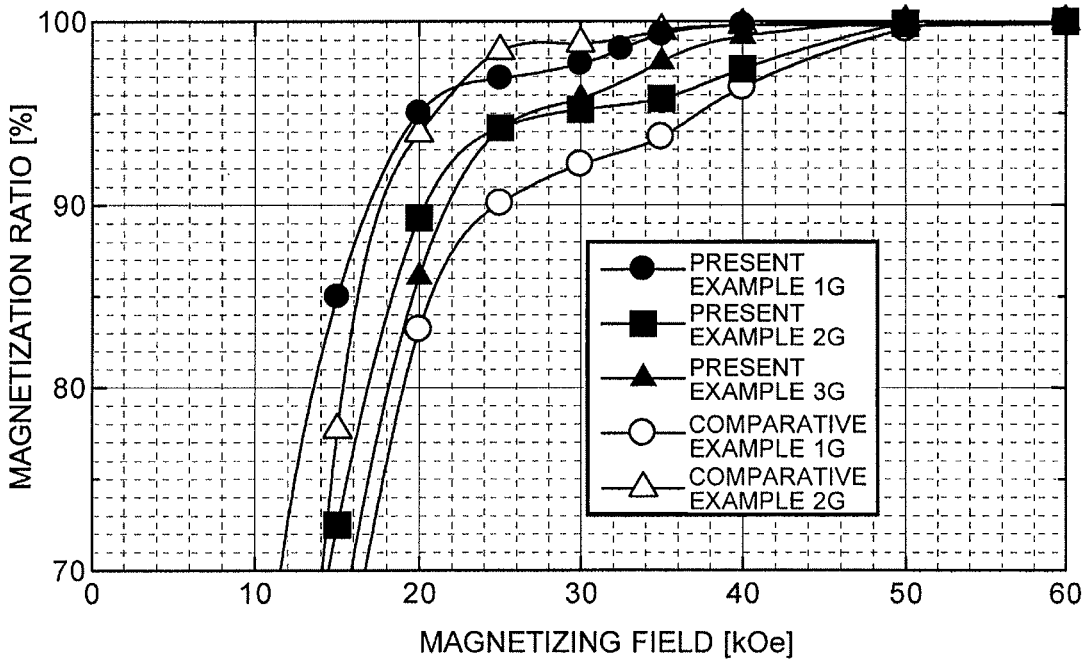
FIG. 3 is a graph showing magnetization characteristics in Present Examples 1G-3G as well as in Comparative Examples 1G and 2G.

FIG. 3 shows the result of the experiment of the magnetization characteristic measurement performed on Present Examples 1G-3G as well as Comparative Examples 1G and 2G. In any of these cases, as compared to the samples before the grain boundary diffusion process shown in FIG. 2, the magnetization ratio is lower at any intensity of magnetic field, and a plateau area is present in the magnetization curve. These facts suggest that the magnetization characteristic has been deteriorated. Such a deterioration in magnetization characteristic is inevitable as long as the grain boundary diffusion process is performed, since it results from the fact that the grain boundary diffusion process increases the magnetization of individual crystal grains and makes the reversal of magnetization more difficult. However, the fact that the magnetization characteristics of Present Examples 1G-3G are higher than that of Comparative Example 1G also confirms that the present invention exhibits a certain effect when the comparison is made among the magnets which have undergone the grain boundary diffusion process. Comparative Example 2G is comparable to those of Present Examples 1G-3G in terms of magnetization characteristic. However, its coercive force $H_{cJ}$ is comparatively low, as shown in Table 4.

Figure 4:
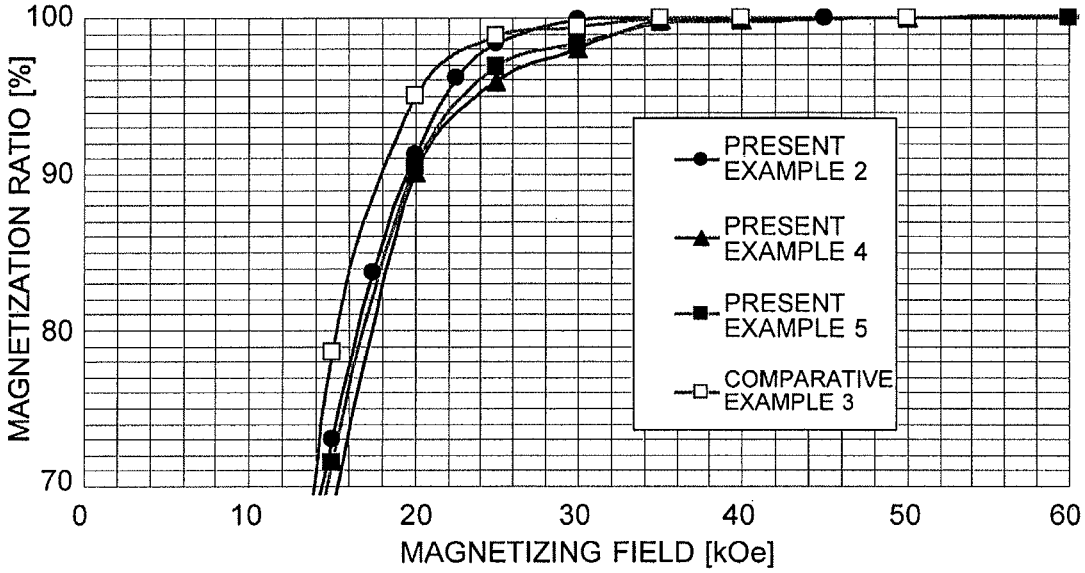
FIG. 4 is a graph showing magnetization characteristics in Present Examples 2, 4 and 5 as well as in Comparative Example 3.

FIG. 4 shows the result of the experiment of the magnetization characteristic measurement performed on Present Examples 2, 4 and 5 as well as Comparative Example 3, which all have the same composition. Regardless of the distinction of Present and Comparative Examples, these samples required a comparatively high magnetic field of 35 kOe in order to achieve a magnetization ratio of 100%. Meanwhile, these samples exceeded a magnetization ratio of 90% when the magnetic field was 20 kOe, regardless of the distinction of Present and Comparative Examples. Among Present Examples 2, 4 and 5, Present Example 2 having the highest magnetization ratio and the least noticeable plateau area can be said to have the highest magnetic characteristic. Comparative Example 3 has a high magnetization characteristic but a low coercive force, as noted earlier. Thus, it is not Comparative Example 3 but Present Examples 2, 4 and 5 that has achieved the objective of the present invention, i.e. "to obtain a NdFeB system sintered magnet having both a high coercive force and a high magnetization ratio."

Figure 5:
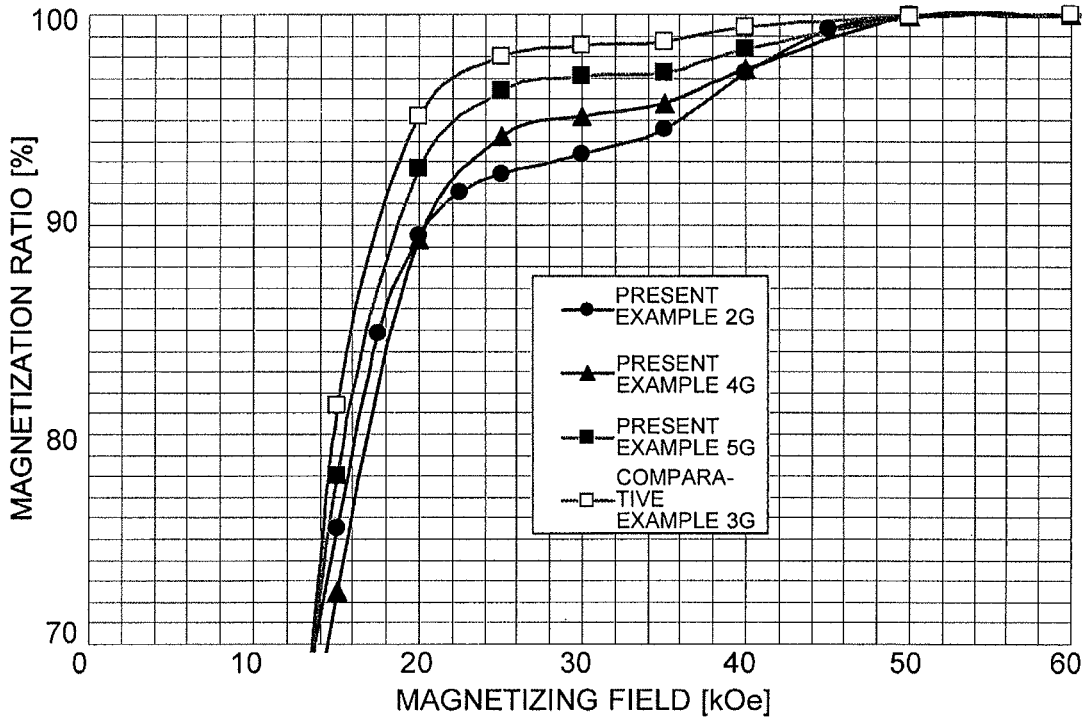
FIG. 5 is a graph showing magnetization characteristics in Present Examples 2G, 4G and 5G as well as in Comparative Example 3G.

FIG. 5 shows the result of the experiment of the magnetization characteristic measurement performed on Present Examples 2G, 4G and 5G as well as Comparative Example 3G which were all subjected to the grain boundary diffusion process. Similar to the case of FIG. 3, those samples have their magnetization characteristic deteriorated as compared to the samples before the grain boundary diffusion process. However, they show a tendency similar to Present Examples 2, 4 and 5 as well as Comparative Example 3 shown in FIG. 4.

Figure 6:
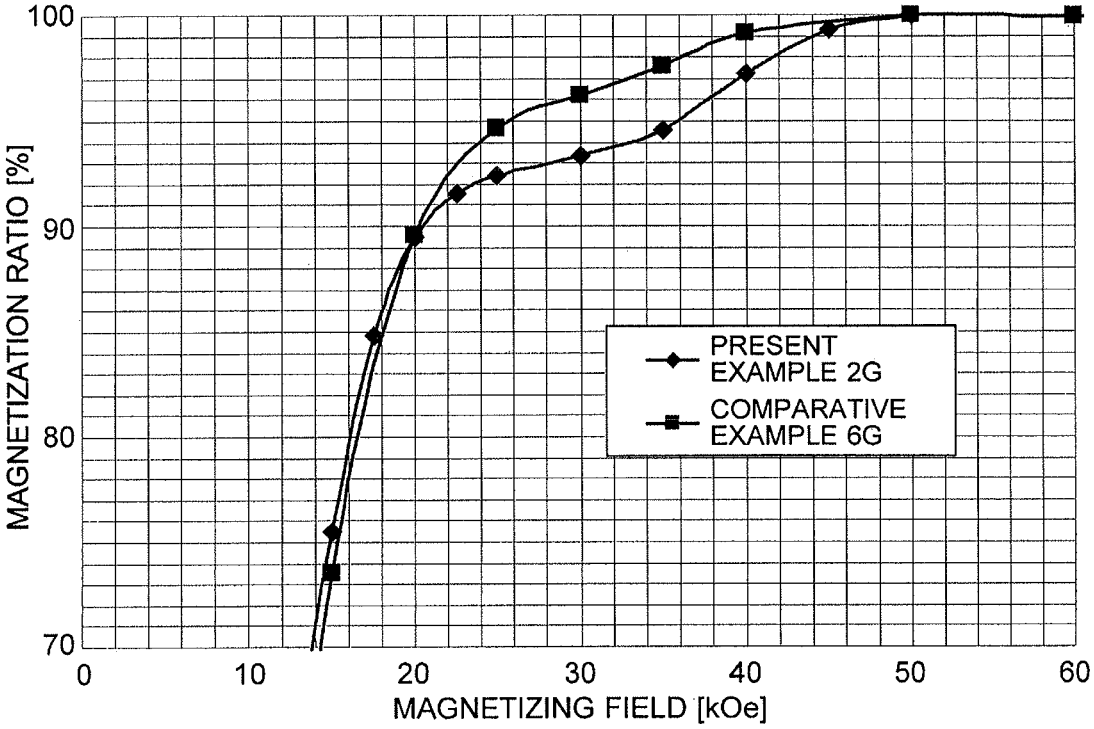
FIG. 6 is a graph showing magnetization characteristics in Present Examples 2G and 6G.

FIG. 6 shows the result of the experiment of the magnetization characteristic measurement performed on Present Example 6G, together with the magnetization characteristic of Present Example 2G. Present Example 6G is similar to Present Example 2G in respect of the composition and the particle size of the alloy powder, except it contains 0.2% by weight of Ga. Present Example 6G has a higher magnetization characteristic than Present Example 2G. It can be said that such a high magnetization characteristic results from the fact that Present Example 6G contains Ga.

An experiment for determining the grain size distribution of the crystal grains in Present Examples 1-5 and Comparative Examples 1-3 was performed in order to clarify the reason why the previously described differences in the magnetic characteristics and the magnetization characteristic occurred among the samples.

Figure 7:
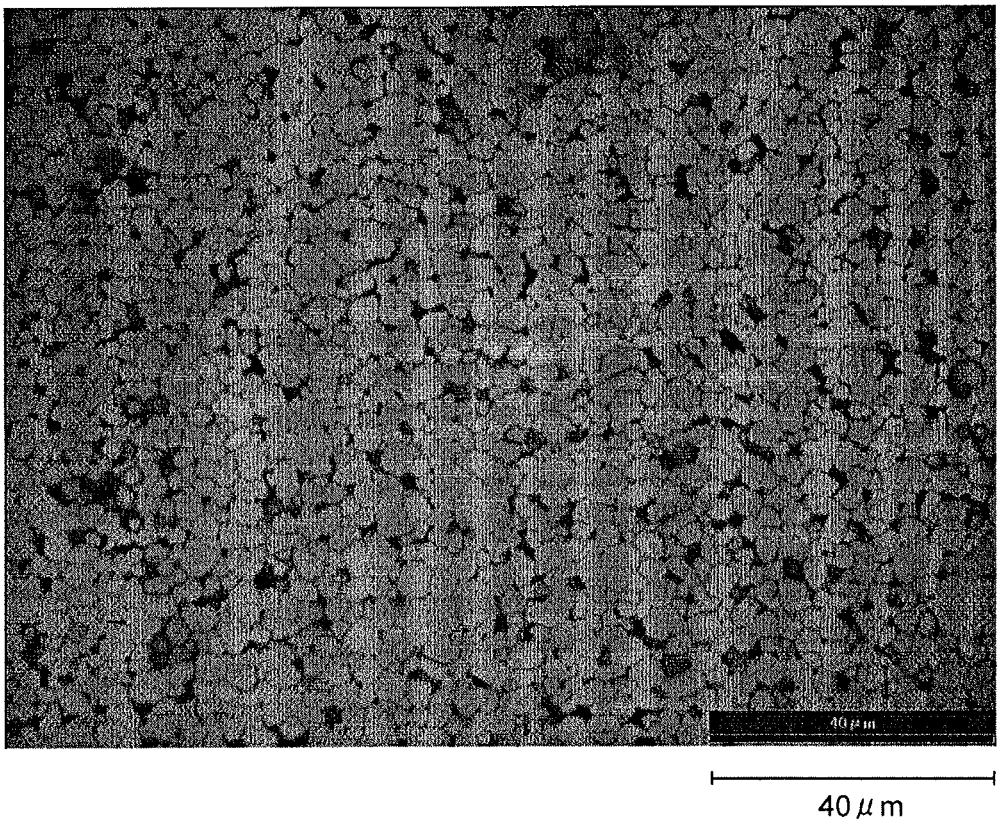
FIG. 7 is an optical micrograph at a $c_{\perp}$ plane of the NdFeB system sintered magnet in Present Example 1.
Figure 8:
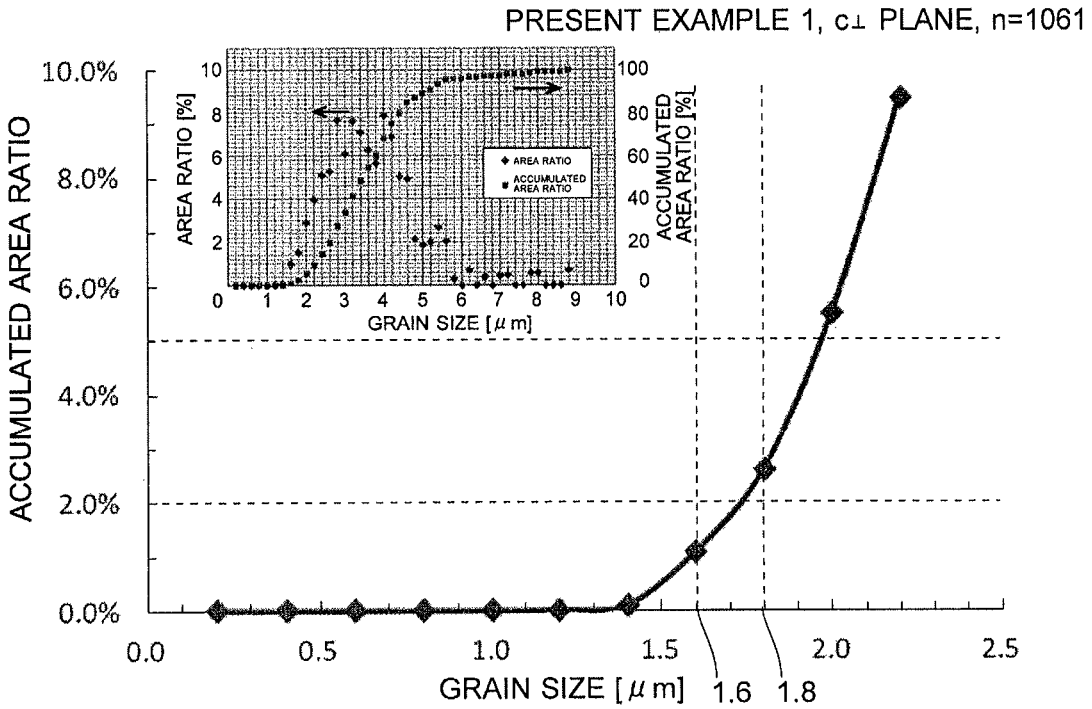
FIG. 8 is a graph showing the grain size distribution on a $c_{\perp}$ plane of the NdFeB system sintered magnet in Present Example 1.
Figure 9:
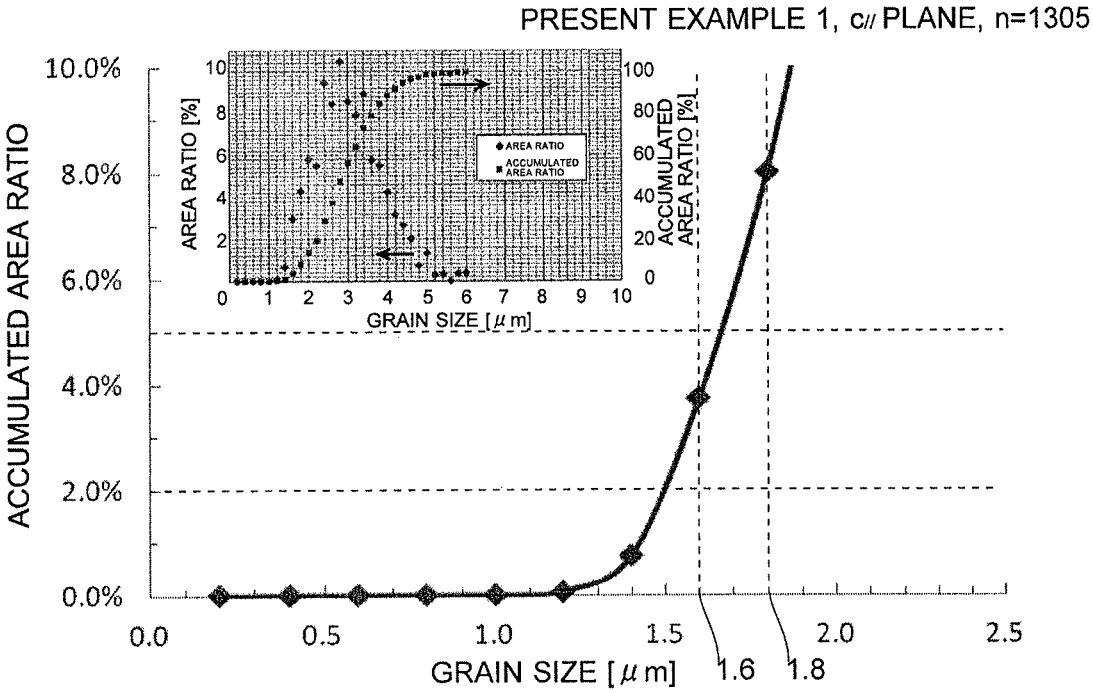
FIG. 9 is a graph showing the grain size distribution on a $c_{//}$ plane of the NdFeB system sintered magnet in Present Example 1.
Figure 10:
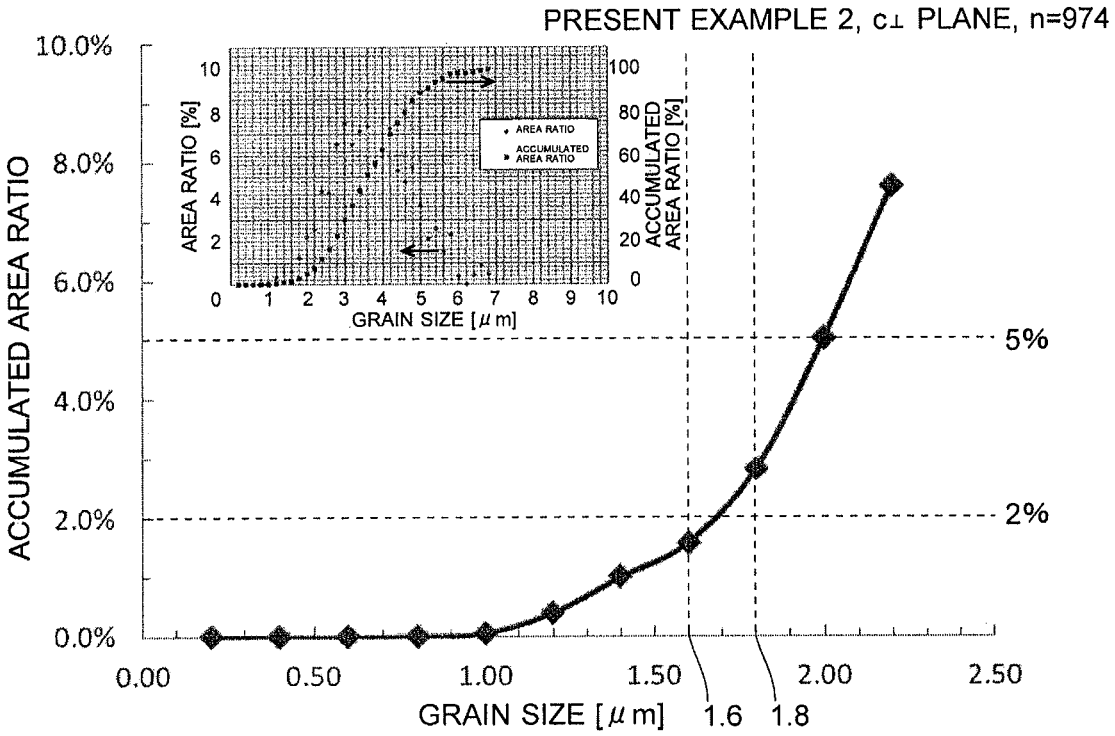
FIG. 10 is a graph showing the grain size distribution on a $c_{\perp}$ plane of the NdFeB system sintered magnet in Present Example 2.
Figure 11:
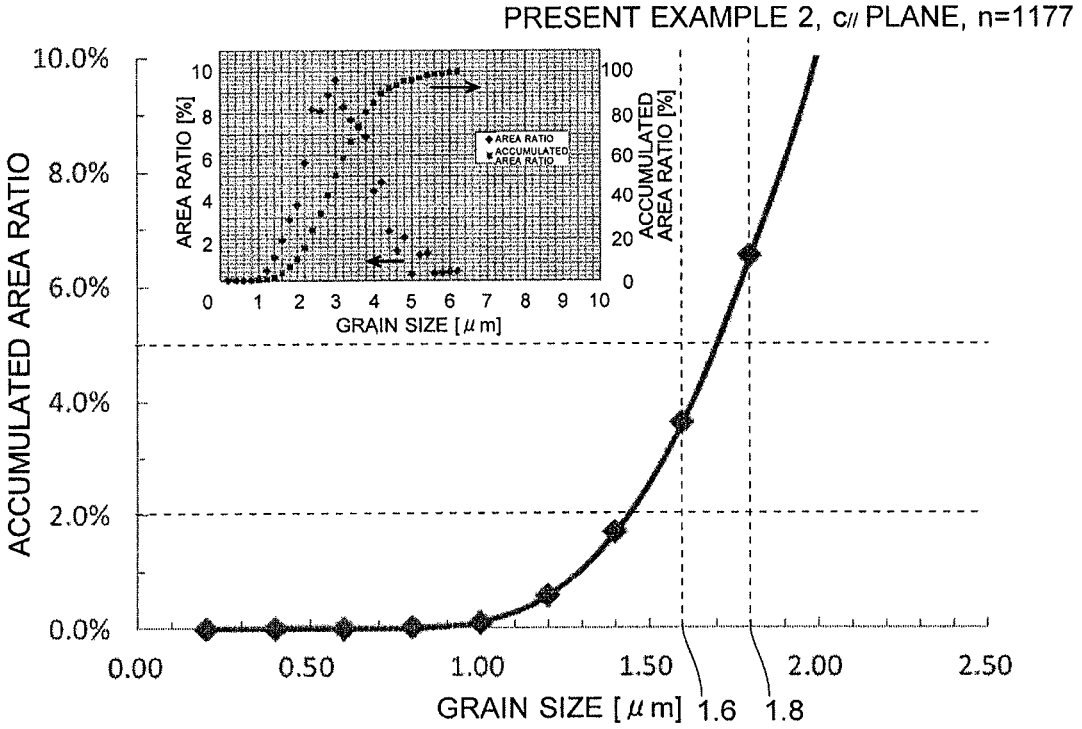
FIG. 11 is a graph showing the grain size distribution on a $c_{//}$ plane of the NdFeB system sintered magnet in Present Example 2.
Figure 12:
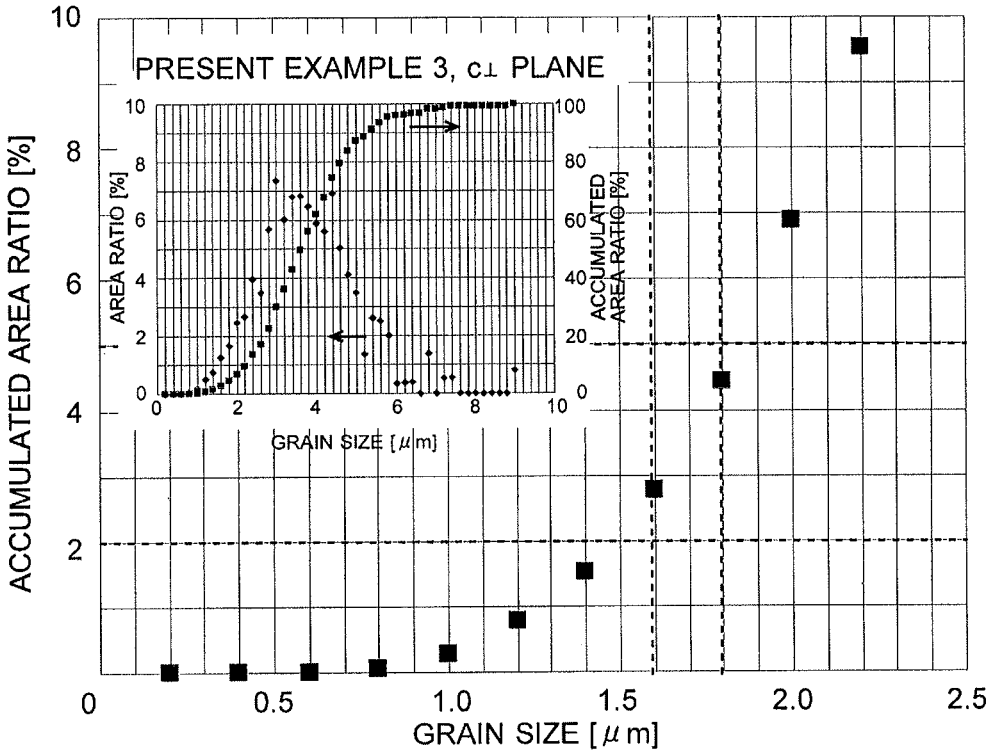
FIG. 12 is a graph showing the grain size distribution on a $c_{\perp}$ plane of the NdFeB system sintered magnet in Present Example 3.
Figure 13:
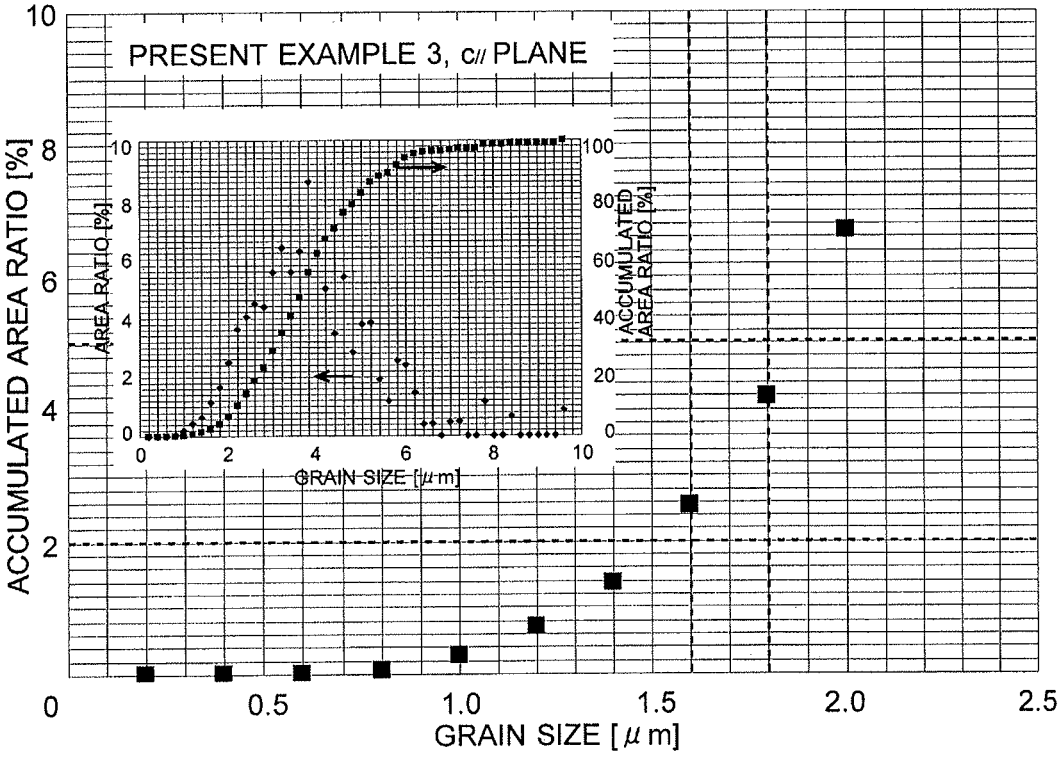
FIG. 13 is a graph showing the grain size distribution on a $c_{//}$ plane of the NdFeB system sintered magnet in Present Example 3.
Figure 14:
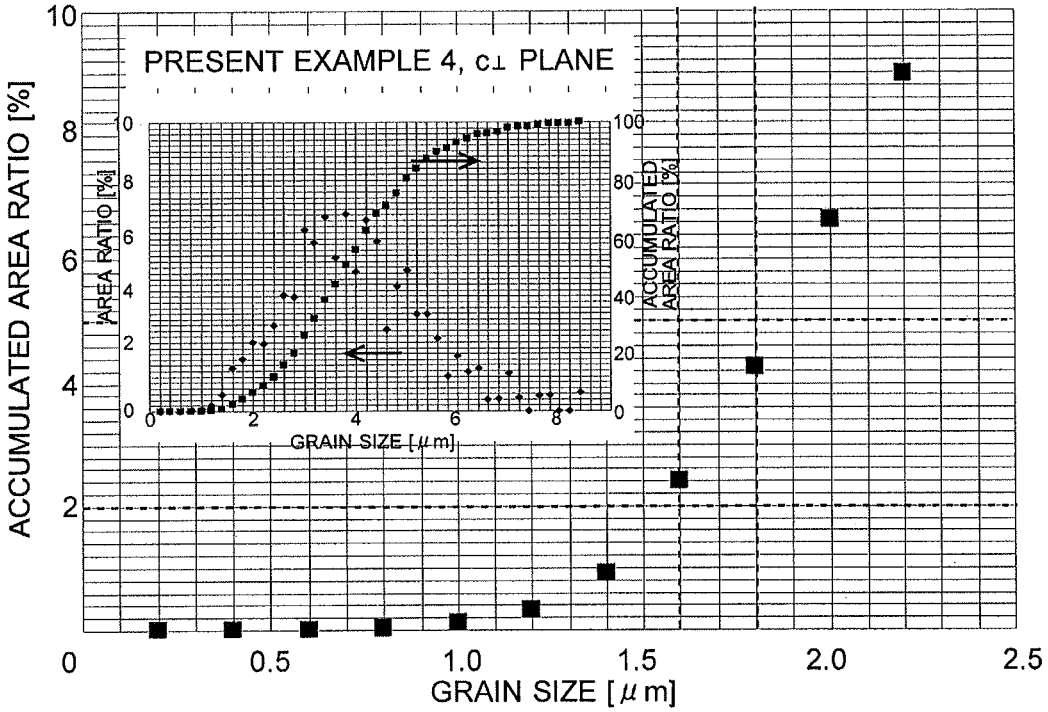
FIG. 14 is a graph showing the grain size distribution on a $c_{\perp}$ plane of the NdFeB system sintered magnet in Present Example 4.
Figure 15:
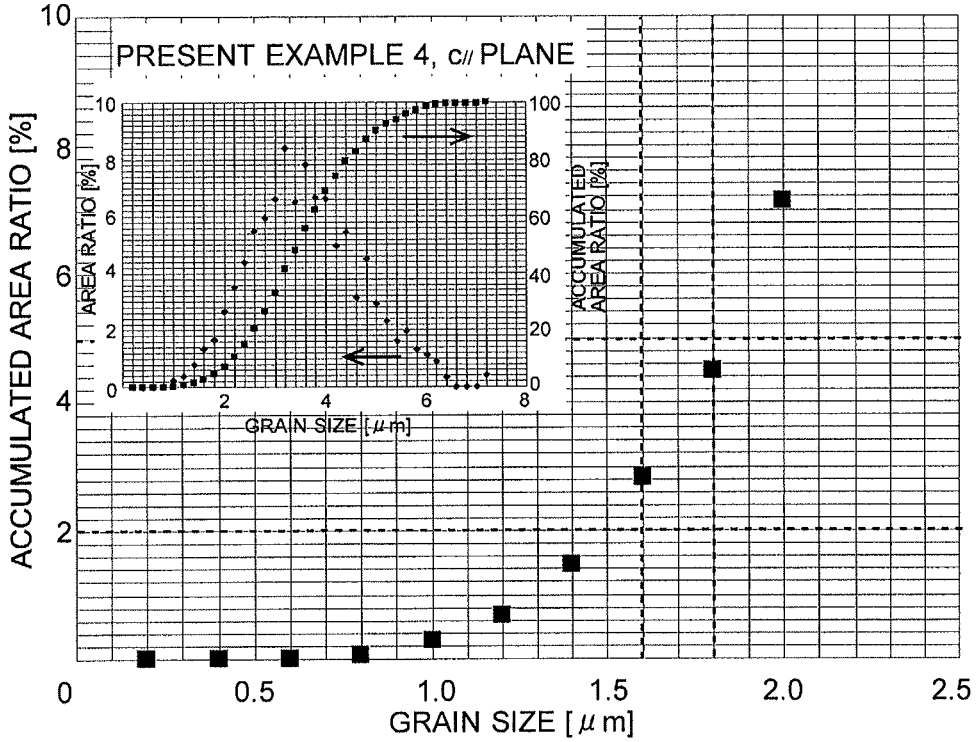
FIG. 15 is a graph showing the grain size distribution on a $c_{//}$ plane of the NdFeB system sintered magnet in Present Example 4.
Figure 16:
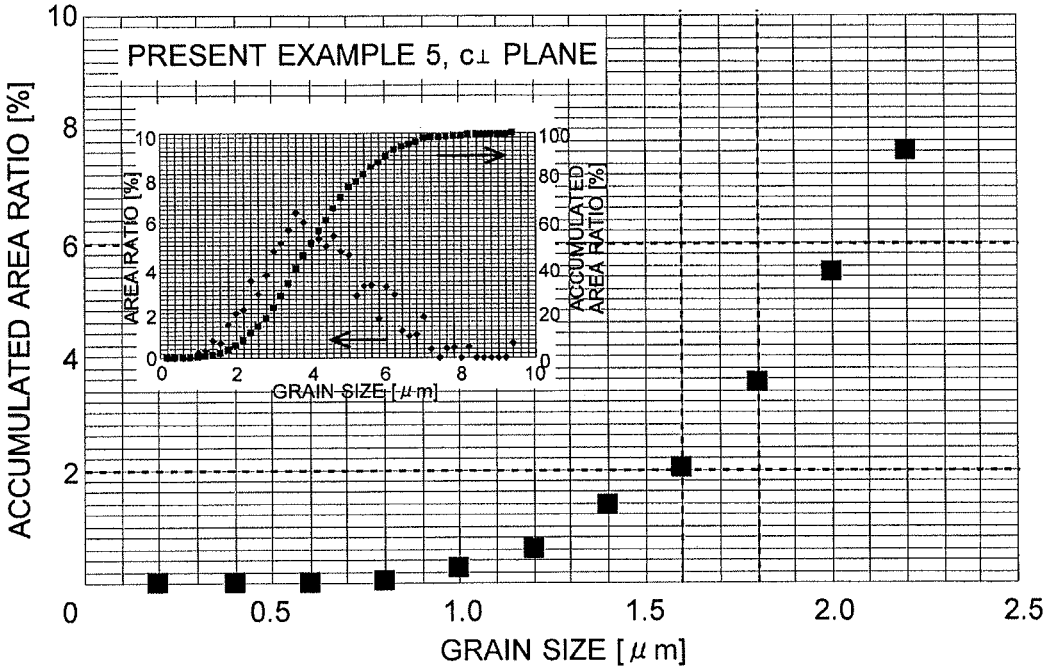
FIG. 16 is a graph showing the grain size distribution on a $c_{\perp}$ plane of the NdFeB system sintered magnet in Present Example 5.
Figure 17:
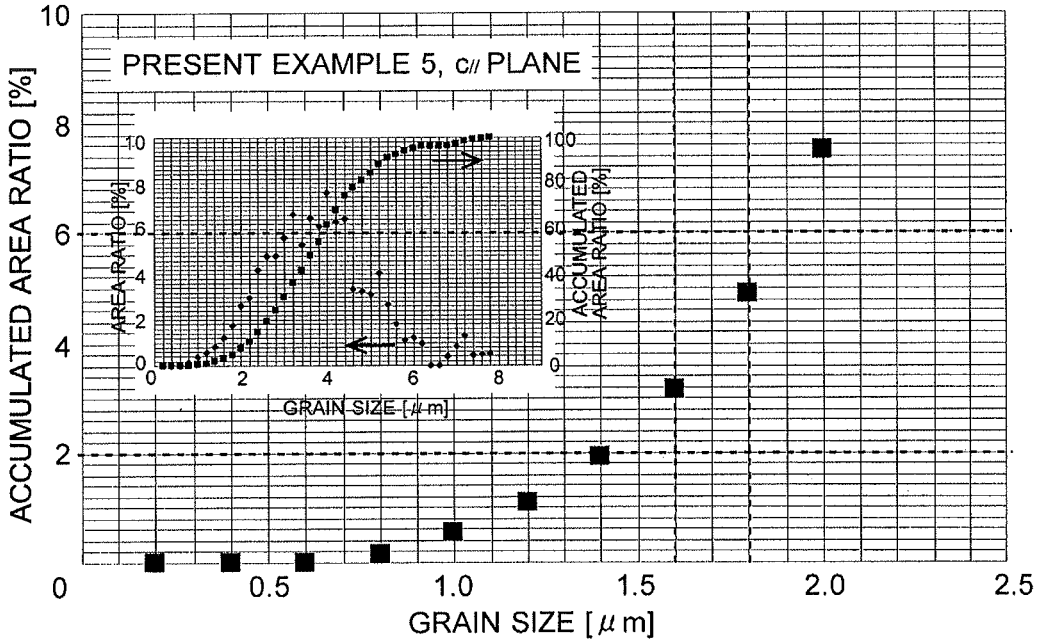
FIG. 17 is a graph showing the grain size distribution on a $c_{//}$ plane of the NdFeB system sintered magnet in Present Example 5.
Figure 18:
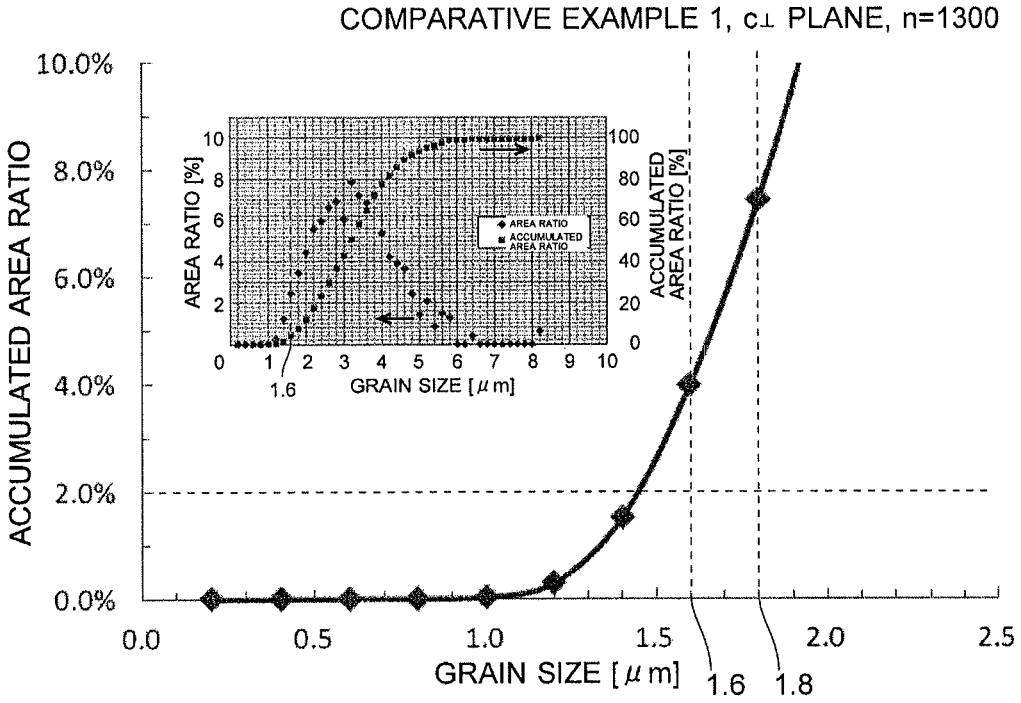
FIG. 18 is a graph showing the grain size distribution on a $c_{\perp}$ plane of the NdFeB system sintered magnet in Comparative Example 1.
Figure 19:
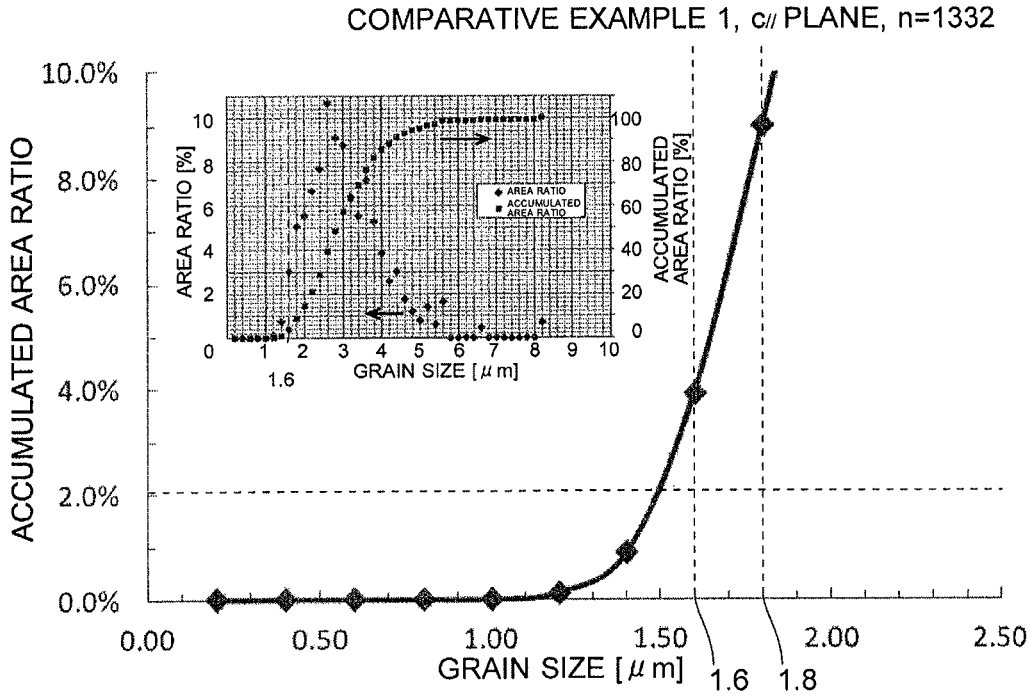
FIG. 19 is a graph showing the grain size distribution on a $c_{//}$ plane of the NdFeB system sintered magnet in Comparative Example 1.
Figure 20:
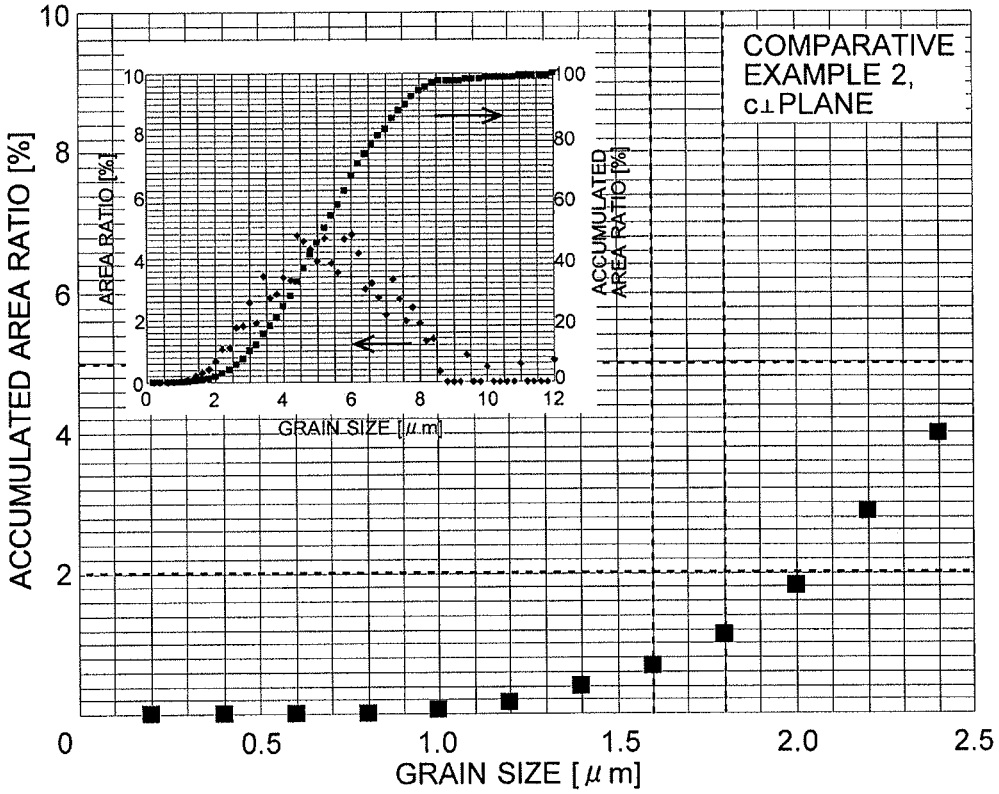
FIG. 20 is a graph showing the grain size distribution on a $c_{\perp}$ plane of the NdFeB system sintered magnet in Comparative Example 2.
Figure 21:
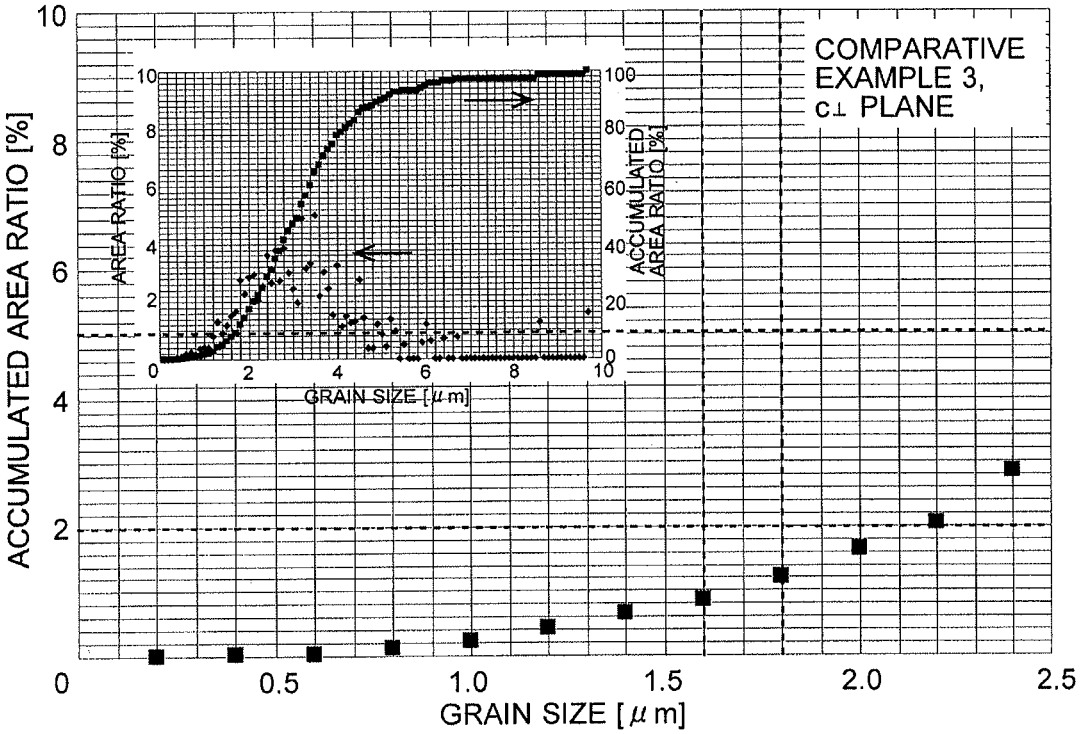
FIG. 21 is a graph showing the grain size distribution on a $c_{\perp}$ plane of the NdFeB system sintered magnet in Comparative Example 3.

In this experiment, optical microphotographs of three randomly selected visual fields with an actual size of approximately 140 μm×110 μm were taken at 1000-fold magnification on a plane perpendicular to the thickness (c axis) of the NdFeB system sintered magnet ($c_\perp$ plane) and on a plane parallel to the thickness direction (which is hereinafter called the "$c_{//}$ plane"). As one example, FIG. 7 shows an optical microphotograph on a $c_\perp$ plane in Present Example 1. Next, an image analysis of those optical microphotographs using an image analyzer (LUZEX AP, manufactured by Nireco Corporation) was performed as follows: Initially, an image processing for adjusting the brightness, contrast and other parameters was performed so as to make the grain boundaries of the crystal grains clearly visible. Subsequently, the sectional area of each crystal grain was calculated. Then, on the assumption that the section of each crystal grain was a circle whose area equals the calculated sectional area of that crystal grain, the circle's diameter was calculated as the grain size of the crystal grain. Such a calculation of the grain size was performed for all the crystal grains in the three visual fields, and the grain size distribution was computed.

FIGS. 8-21 show the computed grain size distributions of the crystal grains in the NdFeB system sintered magnets of Present Examples 1-5 and Comparative Examples 1-3. In any of these graphs of grain size distribution, the crystal grains were divided into unit grain sizes defined at grain-size intervals of 0.2 μm (0-0.2 μm, 0.2-0.4 μm, and so on). The number of grains was counted for each unit grain size, and the "area ratio" was calculated by $n_i\sigma_i/S$, where $n_i$ is the number of grains at each unit grain size, $\sigma_i$ is the average sectional area at each unit grain size, and S is the sectional area of the entire target of the measurement (see the insert in each figure). Furthermore, the sum of the area ratios obtained at the unit grain sizes equal to or less than a currently-focused unit grain size is defined as the "accumulated area ratio" at that unit grain size. Accordingly, the accumulated area ratio at a unit grain size of 1.8 μm corresponds to the aforementioned "area ratio of the crystal grains having grain sizes of 1.8 μm or smaller." In each figure, the larger graph shows the accumulated area ratio within a grain-size range of 2.5 μm or less, while the insert shows the area ratio and the accumulated area ratio over the entire grain-size range. The total number "n" of crystal grains within the entire area of the measurement target is also shown in some figures. For Comparative Examples 2 and 3, only the data of the $c_\perp$ plane are shown.

From these grain-size distribution graphs, the accumulated area ratios at grain sizes of 1.6 μm and 1.8 μm were calculated, the results of which were as shown in Table 5 ($c_\perp$ plane) and Table 6 ($c_{//}$ plane).

TABLE 5

($c_\perp$ plane)

| | Grain Size D50 of Crystal Grains [μm] | Accumulated Area Ratio (%) Grain Size 1.8 μm | Accumulated Area Ratio (%) Grain Size 1.6 μm |
|---|---|---|---|
| Present Example 1 | 3.42 | 2.8 | 1.08 |
| Present Example 2 | 3.55 | 2.8 | 1.58 |
| Present Example 3 | 3.6 | 4.4 | 2.3 |
| Present Example 4 | 3.8 | 4.2 | 2.4 |
| Present Example 5 | 4.0 | 3.5 | 2.1 |
| Comparative Example 1 | 3.2 | 7.5 | 3.99 |
| Comparative Example 2 | 5.2 | 1.1 | 0.7 |
| Comparative Example 3 | 6.3 | 1.2 | 0.9 |

TABLE 6

($c_{//}$ plane)

| | Grain Size D50 [μm] of Crystal Grains | Accumulated Area Ratio (%) Grain Size 1.8 μm | Accumulated Area Ratio (%) Grain Size 1.6 μm |
|---|---|---|---|
| Present Example 1 | 3.0 | 8.0 | 3.62 |
| Present Example 2 | 2.9 | 6.6 | 3.73 |
| Present Example 3 | 3.7 | 4.2 | 2.5 |
| Present Example 4 | 3.4 | 4.5 | 2.9 |
| Present Example 5 | 3.6 | 4.9 | 3.2 |
| Comparative Example 1 | 3.2 | 7.5 | 3.99 |

From the results shown in these tables, the following facts can be extracted: On the $c_\perp$ plane, the area ratio of the crystal grains having grain sizes of 1.8 μm or smaller was 5% or lower in any of Present Examples 1-5, while Comparative Example 1 had a high value of 7.5%. By contrast, on the $c_{//}$ plane, there was no significant difference in the area ratio of the crystal grains having grain sizes of 1.8 μm or smaller between Present and Comparative Examples. The median $D_{50}$ of the grain size of the crystal grains was less than 4.5 μm in any of those examples and there was no noticeable difference between Present and Comparative Examples as well as between the $c_\perp$ and $c_{//}$ planes. Comparative Examples 2 and 3, in which the area ratio of the grain size of 1.8 μm or smaller on the $c_\perp$ plane was lower than 5%, are not included in the present invention, since the median $D_{50}$ of the grain size of the crystal grains, which is the index relating to the coercive force, is greater than 4.5 μm.

Thus, it has been demonstrated that a magnetization ratio of 90% or higher can be achieved using an external magnetic field of 20 kOe in the samples of Present Examples 1-5 in which the area ratio of the crystal grains having grain sizes of 1.8 μm or smaller on a $c_\perp$ plane is 5% or lower. This is probably due to the fact that the volume occupied by crystal grains having small grain sizes (or the area occupied on a section of the sintered magnet) is thereby reduced, so that single-domains are less likely to be formed.

It should be noted that the area ratio of the crystal grains having grain sizes of 1.6 μm or smaller on a $c_{\perp}$ plane is 2% or lower in Present Examples 1 and 2, whereas the ratio is higher than 2% in Present Examples 3-5. This result corresponds to the fact that no plateau area is noticeable in Present Examples 1 and 2.

Figure 22:
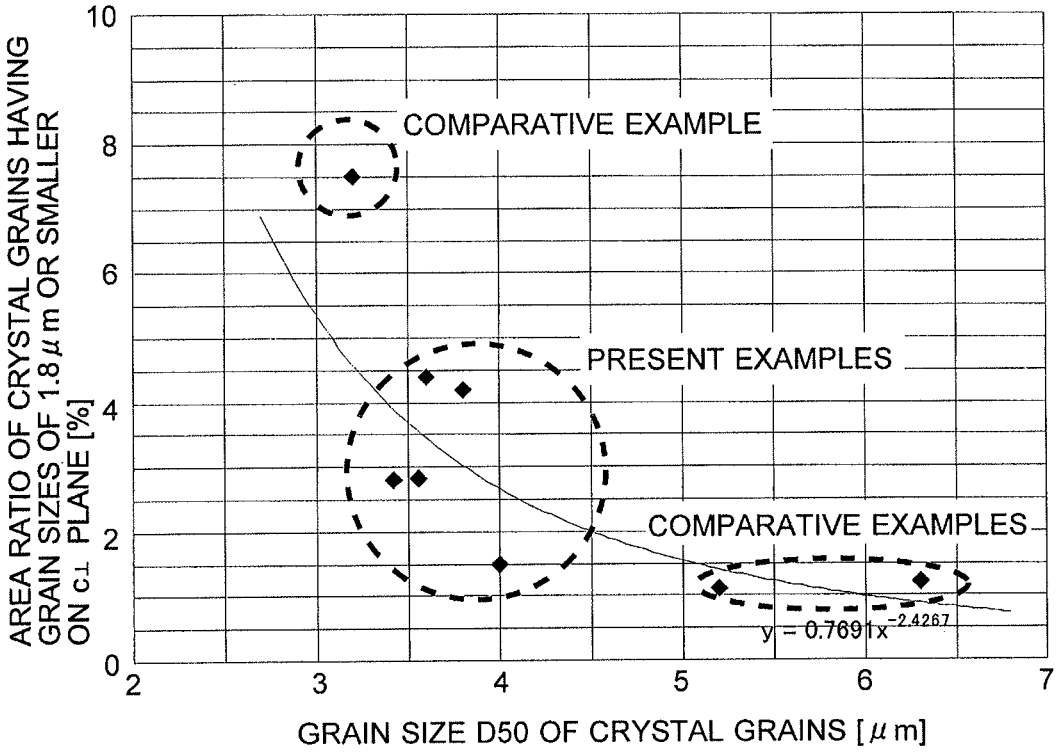
FIG. 22 is a graph showing the relationship between the median $D_{50}$ of the grain size of the crystal grains and the area ratio of the crystal grains whose grain sizes on a $c_{\perp}$ plane are 1.8 μm or smaller.

FIG. 22 is a graph created based on the experimental results of Present Examples 1-5 and Comparative Examples 1-3, which shows the relationship between the median $D_{50}$ of the grain size of crystal grains and the area ratio of the crystal grains having grain sizes of 1.8 μm or smaller on a $c_{\perp}$ plane (the accumulated area ratio at 1.8 μm). This graph shows that there is a trade-off between the two indices. That is to say, reducing the median $D_{50}$ of the grain size to improve the coercive force inevitably increases the accumulated area ratio at 1.8 μm on the $c_{\perp}$ plane and consequently deteriorates the magnetization characteristic. Conversely, decreasing the accumulated area ratio at 1.8 μm on the $c_{\perp}$ plane to improve the magnetization characteristic inevitably increases the median $D_{50}$ of the grain size and consequently decreases the coercive force. Accordingly, when determining these two indices, it is necessary to strike a balance between the two so that the median $D_{50}$ of the grain size will be 4.5 μm or less while the accumulated area ratio at 1.8 μm on the $c_{\perp}$ plane will be 5% or less.

REFERENCE SIGNS LIST

10 . . . NdFeB System Sintered Magnet
11 . . . Multi-Domain Grain
12 . . . Single-Domain Grain
13 . . . Magnetic Domain Formed in Multi-Domain Grain
14 . . . Reverse Magnetic Domain Formed in Single-Domain Grain

The invention claimed is:

1. A NdFeB system sintered magnet with a c axis oriented in one direction comprising:

a median of a grain size of crystal grains at a section perpendicular to the c axis is 4.5 μm or smaller, the grain size being calculated as a diameter of a circle having an area equal to a sectional area of each crystal grain; and an area ratio defined by a ratio of an area of the crystal grains having grain sizes of 1.8 μm or smaller on the section perpendicular to the c axis over an area of all crystal grains in the section perpendicular to the c axis is 5% or lower; wherein the crystal grains having grain sizes of 1.8 μm or smaller are single-domain grains.

2. A NdFeB system sintered magnet with a c axis oriented in one direction, comprising:

a median of a grain size of crystal grains at a section perpendicular to the c axis is 4.5 μm or smaller, the grain size being calculated as a diameter of a circle having an area equal to a sectional area of each crystal grain; and an area ratio defined by a ratio of an area of the crystal grains having grain sizes of 1.6 μm or smaller on the section perpendicular to the c axis over an area of all crystal grains in the section perpendicular to the c axis is 2% or lower;

wherein the crystal grains having grain sizes of 1.6 μm or smaller are single-domain grains.

3. The NdFeB system sintered magnet according to claim 1, wherein a content ratio of a rare-earth element is 31% by weight or higher.

4. The NdFeB system sintered magnet according to claim 1, contains one or more kinds of metal elements having a melting point of 700° C. or lower.

5. The NdFeB system sintered magnet according to claim 4, wherein the metal element or elements are one or more kinds selected from a group of Al, Mg, Zn, Ga, In, Sn, Sb, Te, Pb and Bi.

6. The NdFeB system sintered magnet according to claim 1, wherein an element of Dy and/or Tb is diffused only in regions near grain boundaries of the crystal grains.

7. The NdFeB system sintered magnet according to claim 2, wherein a content ratio of a rare-earth element is 31% by weight or higher.

8. The NdFeB system sintered magnet according to claim 2, contains one or more kinds of metal elements having a melting point of 700° C. or lower.

9. The NdFeB system sintered magnet according to claim 8, wherein the metal element or elements are one or more kinds selected from a group of Al, Mg, Zn, Ga, In, Sn, Sb, Te, Pb and Bi.

10. The NdFeB system sintered magnet according to claim 2, wherein an element of Dy and/or Tb is diffused only in regions near grain boundaries of the crystal grains.

* * * * *